United States Patent [19]

Chu et al.

[11] Patent Number: 4,840,504

[45] Date of Patent: Jun. 20, 1989

[54] PRINTER RIBBON CARTRIDGE WITH MEANS FOR TRANSVERSELY DISPLACING RIBBON DURING ADVANCE

[75] Inventors: Mosi Chu, Setauket; Anthony Graziano, Bay Shore; Kenneth Kress, Huntington, all of N.Y.

[73] Assignee: Primages, Inc., Del.

[21] Appl. No.: 48,237

[22] Filed: May 11, 1987

Related U.S. Application Data

[63] Continuation-in-part of Ser. No. 871,369, Jun. 6, 1986, abandoned, Continuation-in-part of Ser. No. 609,784, May 14, 1984, Pat. No. 4,623,271.

[51] Int. Cl.[4] ..... B41J 33/56

[52] U.S. Cl. ..... 400/213; 400/208; 400/248

[58] Field of Search ..... 400/195, 196.1, 207, 400/208, 208.1, 213, 216.2, 217, 223, 224, 248

[56] References Cited

U.S. PATENT DOCUMENTS

| | | | |
|---|---|---|---|
| 1,114,532 | 10/1914 | Sargent et al. | 400/248 X |
| 2,386,439 | 10/1945 | Cordis | 400/248 |
| 2,734,615 | 2/1956 | Van Wallendael | 400/213 X |
| 2,747,718 | 5/1956 | May | 400/248 X |
| 3,863,749 | 2/1975 | Perry et al. | 400/213 X |
| 4,297,043 | 10/1981 | Dargartz | 400/248 X |
| 4,368,993 | 1/1983 | Brass et al. | 400/216.2 |
| 4,611,938 | 9/1986 | Rettke et al. | 400/208 X |
| 4,623,271 | 11/1986 | Kress | 400/208 |
| 4,650,355 | 3/1987 | Cassiano et al. | 400/196.1 |
| 4,657,418 | 4/1987 | Lahr | 400/208 X |

FOREIGN PATENT DOCUMENTS

| | | | |
|---|---|---|---|
| 8505326 | 12/1985 | Italy | 400/208 |
| 0027385 | 3/1981 | Japan | 400/248 |
| 0089979 | 7/1981 | Japan | 400/196.1 |
| 0057688 | 4/1982 | Japan | 400/213 |
| 0059488 | 4/1984 | Japan | 400/224 |
| 0010987 | 6/1984 | Japan | 400/213 |
| 24359 | of 1904 | United Kingdom | 400/248 |

OTHER PUBLICATIONS

IBM Technical Disclosure Bulletin, "Ribbon Feeding Device", Reed, vol. 2, No. 5, Feb. 1960, p. 5.

IBM Technical Disclosure Bulletin, "Ribbon Oscillating Guide Mechanism", Kirksey et al, vol. 16, No. 5, Oct. 1973, pp. 1518–1519.

*Primary Examiner*—Ernest T. Wright, Jr.

*Attorney, Agent, or Firm*—Roberts, Spiecens & Cohen

[57] ABSTRACT

An ink ribbon cartridge for a printer comprising a storage reel for an ink ribbon, a take-up reel for the ink ribbon, drive wheels for longitudinally advancing the ink ribbon from the storage reel to the take-up reel for printing on the ribbon, and a pulley or roller which rides on the cam and which is coupled to a further pulley or roller, these parts cooperating for transversely displacing the ribbon during its longitudinal advance to offset the area of the ribbon utilized in printing.

5 Claims, 2 Drawing Sheets

FIG. 3
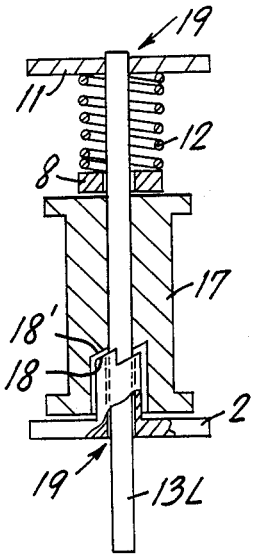
FIG. 4
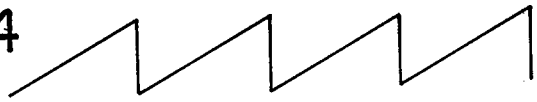
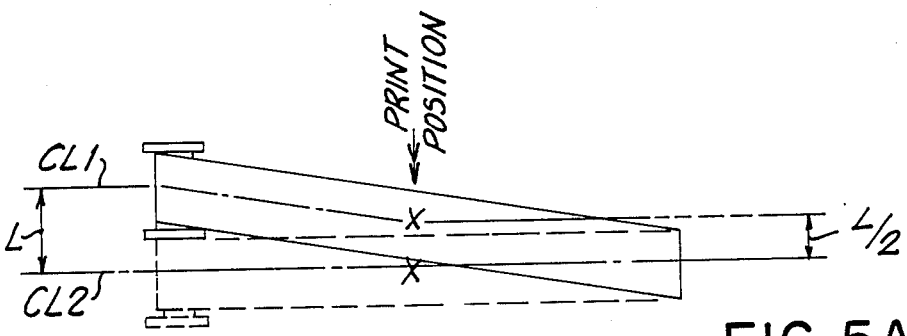
FIG. 5A
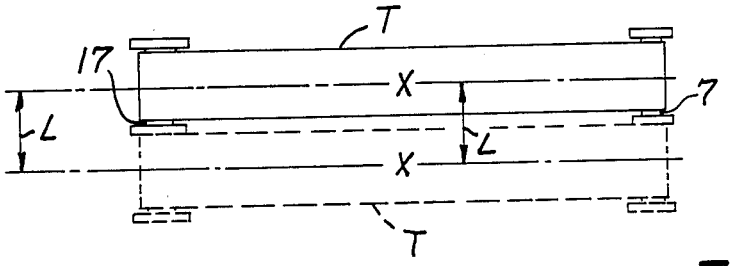
FIG. 5B

PRINTER RIBBON CARTRIDGE WITH MEANS FOR TRANSVERSELY DISPLACING RIBBON DURING ADVANCE

REFERENCE TO RELATED APPLICATIONS

This application is a continuation-in-part based on earlier filed applications Ser. No. 871,369 filed June 6, 1986, now abandoned, and Ser. No. 609,784 filed May 14, 1984 which is now U.S. Pat. No. 4,623,271 issued Nov. 18, 1986.

FIELD OF INVENTION

The invention relates to an ink ribbon cartridge for a printer and, more particularly, to apparatus and methods for advancing ink ribbons in cartridges.

BACKGROUND

Ink ribbon cartridges for printers are well known and rely on a substantially longitudinal advance of the ribbon in the course of a printing operation. Such longitudinal advance is uneconomical taking into account the unutilized area of the ribbon in the printing operation.

There have thus been developed ribbon cartridges with multistrike films that allow "overstrike" printing. This means that the ribbon is shifted approximately 1/5 of the width of a conventional character and then again printed on to achieve the conventional so called 5X over-strike ratio.

Because one side of the character has received fresh ribbon while the opposite side of the character has ribbon that has been overstruck five (5) times, the characters are darker on the side that has received the fresh ribbon. This is very apparent on characters that contain horizontal lines such as the letters "E" and "F" and on underscores. To avoid this problem it is known, to those skilled in the art, to vertically displace or dither the ribbon so that the horizontal strokes will be displaced on the ribbon and thus avoid striking the same region of the ribbon.

For the use of one-time film ribbons, which are necessary where very high quality printing is required, the vertical displacement per character must be larger than the height of the printed character itself or else large amounts of ribbon are wasted.

Until recently, displacing the ribbon vertically has involved external means either to lift ribbon or displace the entire cartridge. Such construction is noisy, costly, complex and requires a power drive system. A recent development (see the: above-mentioned U.S. Pat. No. 4,623,271) uses a roller containing an internal cam, mounted within the cartridge, to displace the ribbon vertically. Power for the vertical displacement comes from the rotation of the roller which is driven by the longitudinal advance of the ribbon through friction between the surface of the roller and the surface of the ribbon film.

While the cartridge described in the above-cited U.S. Patent has greatly improved the quality of overstrike printing, it has created a demand for even better cartridges. In particular, the described cartridge has several limitations. First, because only one side of the ribbon is lifted while the other side remains stationary and the print position is in the middle, the amount of vertical displacement at the print position is only one-half of the displacement at the roller. Second, there are limitations to the amount of lift that can be achieved. As the cam angle is increased, the force required to turn the roller also increases until the ribbon "slips" on the roller and the roller stalls. Third, it is not possible to add another lifting roller (with associated cam) to the side of the ribbon that is stationary because there is no way to synchronize both sides. Fourth, because the roller "stalls" when the pressure angle of the cam is too high, the amount of vertical displacement is limited and it is therefore impossible to achieve enough lift for the effective use of one-time film ribbon.

SUMMARY OF THE INVENTION

An object of the invention is to provide an ink ribbon cartridge for a printer and a method of driving of the ribbon by which the ribbon undergoes a dithering displacement without the use of means external of the cartridge.

A further ojbect of the invention is to provide an ink ribbon cartridge in which the advance of the ribbon is effected along an undulating path. In a particular embodiment of the invention, the undulating path is of saw-tooth shape.

It is another object of the invention to provide for a one-to-one ratio between the vertical displacement of an internal cammed roller and the vertical displacement of the ribbon film at the printing position by lifting both sides of the ribbon film in synchronization.

A still further object of the invention is to provide such displacement without the use of external drive means but through the use of the aforementioned "cam" roller without any increase in the pressure angle of the cam.

It is yet another object of the invention to provide such displacement using a mechanism that is of low mass to minimize noise and allow for greater speed of motion while reducing the required drive force.

It is yet a further object of the invention to be able to provide sufficient lift to allow for the efficient use of one-time film ribbon.

In order to satisfy the above objects of the invention, the longitudinally advancing ribbon is subject to a transverse displacement from within the cartridge. Such displacement is in the form of a saw-tooth shape.

According to a feature of the invention, the transverse displacement of the ribbon is effected by engaging the ribbon in the cartridge with a rotatable roller which rides on a fixed cam surface that produces a transverse displacement of the roller as it rotates under the action of the advance of the ribbon film. As a consequence of the arrangement, the roller rides up and down on the fixed cam surface, as it rotates, to produce the transverse displacement of the ribbon film and confer the undulating path of travel to the ribbon film.

More particularly, in a preferred embodiment of the invention, the roller, as it moves transversely in the cartridge, carries with it a ball assembly which spans the width of the cartridge to effect a transverse motion to a freely rotatable second roller mounted on the opposite side of the cartridge and connected by the same bail assembly. As the second roller moves in synchronization with the first roller, it confers the undulating path to the opposite side of the ribbon, thus both sides lift in unison. The resultant vertical lift achieved at the print position is therefore exactly the same as that of the rollers.

BRIEF DESCRIPTION OF THE DRAWING

In the drawing:

FIG. 3 is a partial sectional view of the cam roller taken along the line 3—3 in FIG. 1;

FIG. 4 is a graphical illustration of the path of travel of the ribbon in the cartridge;

FIG. 5A shows the ribbon lift at the print position for the cam roller as described in above cited U.S. Pat. No. 4,623,271; and FIG. 5B shows the roller lift at the print position for the preferred embodiment of the invention.

DETAILED DESCRIPTION

Figure 1:
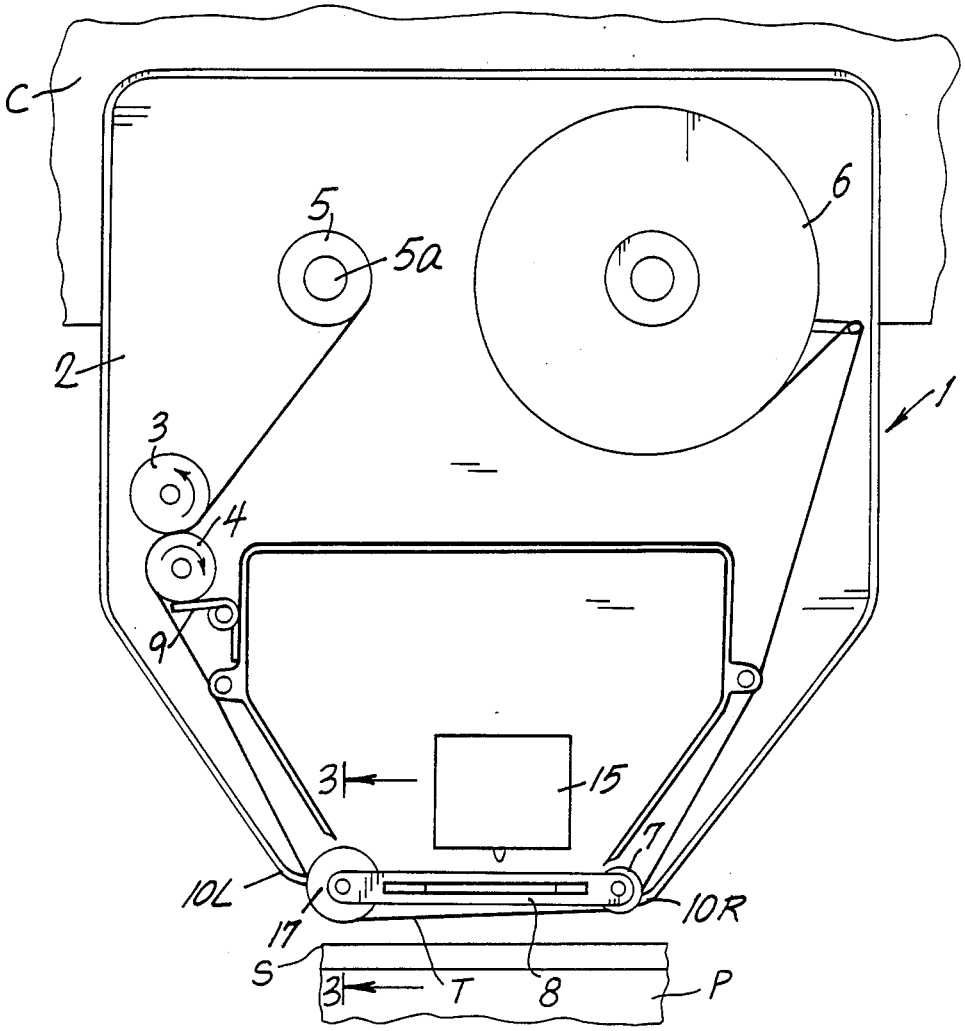
FIG. 1 is a top plan view of an ink ribbon cartridge with the top cover removed to show the interior details.

In FIG. 1 there is shown an ink ribbon cartridge 1, the basic construction of which is conventional in the art. The cartridge 1 is designed for use with a printer by being mounted onto a carrier assembly or carriage C containing a print head 15 and type member assembly (not shown) which is transported along a platen P so as to effect the printing of characters onto a sheet S of paper positioned between the ribbon tape T and the platen P.

The ribbon cartridge 1, contains a supply spool 6, for the ribbon tape T and a take-up reel 5, onto which the ribbon tape T is wound after it has completed the printing operation.

The drive of capstan 3, is effected from the carriage C, by the engagement of a drive member (not shown) mounted on the carriage C and engaged in a slot (not shown) in the bottom of the capstan 3. A pinch roller 4, biased towards the capstan 3, by spring 9, tightly grips the ribbon tape T between it and the capstan 3, so as to impart motion to the ribbon tape T. As the capstan 3, rotates the ribbon tape T is pulled from supply spool 6 causing the supply spool 6 to undergo rotation. Tension is maintained in the ribbon tape T by a commonly known brake or frictional device (not shown) applied to the supply spool 6. A belt (not shown) external to the cartridge 1 connects the drive member to capstan 3 and with a shaft 5*a* of take-up reel 5 so that, as the ribbon tape T is driven by capstan 3, the take-up reel 5 will be rotated and wind up thereon advancing ribbon tape T.

U.S. Pat. No. 4,623,271 cited above shows a suitable capstan 8 having a slot therein and suitably connected to a take-up reel 7 by means of a belt 12 all of which may be used in the above described cartridge 1.

Figure 2:
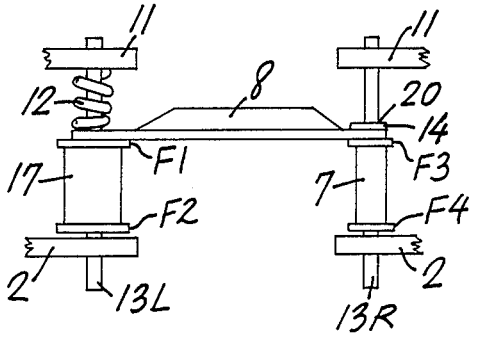
FIG. 2 is a partial front view of the ribbon cartridge showing the bail assembly and rollers.

A shaft 13L shown in FIGS. 2 and 3 is press fit into cam roller 17 at cartridge zone 10L so that no motion between it and the cam roller 17 at cartridge zone 10L, can occur. The shaft 13L passes through clearance holes 19 in the upper and lower halves 11 and 2 of the cartridge case, such that the cam roller 17 and shaft 13L are both free to rotate and to move axially in a vertical direction.

Likewise a shaft 13R is press fit into a cam roller 7 at zone 10R so that no motion between it and the cam roller 7 can occur. The shaft 13R passes through a clearance hole 20 in a bail assembly 8. A captive washer 14 is press fit onto shaft 13R, just above the bail assembly 8 so as to allow free rotation of the roller/shaft assembly 7 and 13R at cartridge zone 10R, while preventing axial displacement between it and the bail assembly 8. The shaft 13R passes through clearance holes 19 in the upper and lower case halves 11 and 2, such that the roller 7 and shaft 13R are both free to rotate and move axially in a vertical direction.

Both rollers 17, and 7 undergo rotation due to the motion of the ribbon tape T and the friction between the surface of the ribbon tape T and the surfaces of both rollers 17 and 7 and because of tension in the ribbon tape T. Rollers 17 and 7 have flanges F1-F4 which embrace ribbon tape T.

As cam roller 17 rotates, it rides vertically upward due to the interaction of camming surface 18, which is part of the lower case half 2, and camming surface 18′ which is part of the cam roller 17. As the cam roller 17 moves vertically upward it carries with it the bail assembly 8 compressing spring 12. As the bail assembly 8 moves vertically upward it carries with it the roller 7 and shaft 13R. The cam surfaces 18 and 18′ must be saw-tooth to provide the desired quality of printing. It can be seen that the small roller 7 moves in unison with the cam roller 17 due to the action of the bail assembly 8. Rollers 7 and 17 carry with them the ribbon tape T.

FIG. 4 is a graphical representation of the saw-tooth path of travel of the ribbon tape T as it undergoes its longitudinal displacement in the cartridge 1.

FIG. 5A shows the vertical lift at the print position for the above-mentioned U.S. Pat. No. 4,623,271. Cam roller 17 rises with lift L from its lowest position (shown in phantom) at CL2 to the maximum lift position at CL1. As can be seen in the illustration, the lift at the print position is L/2. However, as can be seen from FIG. 5B, with the embodiment of the present invention, the lift at the print position is equal to the lift of the cam roller 17, and therefore, for any given lift L of the cam roller 17, twice the lift at the print position is obtained.

There will now be apparent to those skilled in the art many modifications and variations that accomplish the objects of the invention but which do not depart from the spirit thereof.

What is claimed is:

1. An ink ribbon cartridge comprising a case, a storage reel for an ink ribbon, a take-up reel for the ink ribbon, means for longitudinally advancing the ink ribbon from the storage reel to the take-up reel, and means supported by the cartridge for transversely displacing the ribbon during its longitudinal advance including a freely rotatable and axially movable first shaft means supported by said case, a first roller fixed to said first shaft means, freely rotatable and axially movable second shaft means supported by said case, a second roller fixed to said second shaft means, coupling means coupling said first and second shaft means for causing said second shaft means to follow the longitudinal movement of said first shaft means, said ribbon passing on said first roller to rotate said first roller during longitudinal advance of the ribbon, said first roller having an end cam surface, the case having a corresponding cam surface facing and engaging the cam surface on the first roller, said cam surfaces respectively including a plurality of peaks and an inclined surface between successive peaks to produce a saw-tooth path of travel of the ribbons as the ribbon advances.

2. The ink ribbon cartridge of claim 1 wherein said coupling means includes bail means rigidly interconnecting said first and second shaft means.

3. An ink ribbon cartridge as claimed in claim 2 wherein said peaks have vertical edges.

4. An ink ribbon cartridge as claimed in claim 2 wherein said rollers include end flanges which embrace the ribbon.

5. An ink ribbon cartridge as claimed in claim 3 comprising means biassing the first roller towards an initial position from which the first roller is periodically displaced by said cam surfaces.

* * * * *